US006224111B1

(12) United States Patent
Zehner

(10) Patent No.: US 6,224,111 B1
(45) Date of Patent: May 1, 2001

(54) SECURE DOCUMENT

(75) Inventor: George Zehner, Crystal Lake, IL (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 08/909,986

(22) Filed: Aug. 12, 1997

(51) Int. Cl.[7] ..... B41L 1/24; B42D 15/00

(52) U.S. Cl. ..... 283/95; 283/57; 283/58; 283/70; 283/79; 283/91; 283/94; 462/19; 462/22; 462/24; 462/69

(58) Field of Search ..... 283/57, 58, 94, 283/95, 91, 79, 70; 462/19, 22, 24, 69

(56) References Cited

U.S. PATENT DOCUMENTS

| | | | | |
|---|---|---|---|---|
| 1,892,160 | * | 1/1932 | McDonald | 283/58 |
| 3,113,516 | * | 12/1963 | Johnson | 283/58 |
| 4,186,943 | * | 2/1980 | Lee | 283/58 |
| 4,496,961 | * | 1/1985 | Devrient | 346/206 |
| 4,614,363 | * | 9/1986 | Breen | 282/22 |
| 4,936,607 | * | 6/1990 | Brunea et al. | 283/58 |
| 5,413,383 | * | 5/1995 | Laurash et al. | 283/79 |
| 5,522,623 | * | 6/1996 | Soules et al. | 283/91 |
| 5,639,708 | | 6/1997 | Golemo et al. . | |

FOREIGN PATENT DOCUMENTS 0 553 366 A1 8/1993 (EP) .

* cited by examiner

*Primary Examiner*—A. L. Wellington
*Assistant Examiner*—Mark T. Henderson
(74) *Attorney, Agent, or Firm*—Killworth, Gottman, Hagan & Schaeff, L.L.P.

(57) ABSTRACT

Unauthorized alteration of a document can be avoided in a secure document that includes a substrate (10) defining the body of the document. Indicia (24, 26, 30, 32, 36 and 40) located on the substrate (10) designate an area (42) to receive variable information by an impression. The variable information is that whose alteration is to be avoided. A chemical, carbonless imaging system (44) is disposed on the substrate (10) at the area (42) and is operative to form a visible image upon receipt of an impression and a transparent film (46) is located on the substrate (10) to cover the area (42). As a consequence of the construction, any attempt to alter an image appearing on the film (46) will be apparent from the original imaging of the chemical carbonless imaging system (44) or by smudging thereof indicating an alteration attempt.

7 Claims, 1 Drawing Sheet

SECURE DOCUMENT

FIELD OF THE INVENTION

This invention relates to secure documents, that is, documents that receive so called variable information at one or more locations thereon, which information is protected against alteration.

BACKGROUND OF THE INVENTION

There has long been a need for secure documents, that is, documents that cannot be readily copied or counterfeited, or readily altered. As modern technology has progressed, the technology employed by counterfeiters or those who would alter documents for illicit purposes has likewise improved. And, of course, modern society employs a variety of documents for a variety of purposes which can be misused if they can be readily altered, copied or counterfeited.

Of immediate concern as far as the present invention is concerned, is providing a document that is secure against alteration. For example, various forms of documents providing for personal identification such as drivers licenses have been altered, frequently, for the purpose of falsely indicating the birth date of the license holder. Various documents of value, including specifically checks, have been altered to change the stated value of the check.

Other cases where documents may be altered include those where one wishes to alter the date of a document or even alter the signature placed on a document. In each of these cases, it is typically the so-called variable information that is altered.

As is well known, many documents include so-called fixed information which is information that will not change from one document of the same character to the next. For example, the basic format of a common check is fixed information except for that designating the check number. When the check is completed, variable information, including information in the form of the identity of the payee, the signature of the pay or and the amount of the payment as well as the date of the payment is added. This information is termed variable information because it will typically vary from one document to the next, even in the case of the pay or signature as many accounts have more than one signatory who can complete a check.

Quite clearly, it is highly desirable to prevent alteration of such documents so as to prevent misuse of the document. The present invention is directed to accomplishing that goal.

SUMMARY OF THE INVENTION

It is the principal object of the invention to provide a new and improved secure document. More specifically, it is an object of the invention to provide a secure document that cannot be readily altered.

An exemplary embodiment of the invention achieves the foregoing object in a secure document that includes a substrate ply for defining the body of a document. Indicia are provided on the substrate to designate an area to receive variable information by an impression and who's alteration is to be avoided. A chemical carbonless imaging system is located on the substrate at the area and is operative to form a visible image upon receipt of an impression and a transparent film is located on the substrate to cover the area.

In a preferred embodiment, the substrate is paper.

In a preferred embodiment, the chemical carbonless material is operative upon receipt of pressure by a writing or printing instrument to form a visible character or characters at the point or points of application of the pressure.

In a highly preferred embodiment, the film is a coating. Even more preferably, the coating at least partially penetrates the substrate and/or bonds to the surface of the substrate like conventional paints.

In a highly preferred embodiment, the coating is an ink receptive coating.

Most preferably, the coating is an ultraviolet light cured coating.

The invention also contemplates a multiple ply secure document and such includes a record ply substantially abutting the substrate ply along with image transfer material at the interface of the plies so that an impression formed on one of the plies will be transferred to the other.

Other objects and advantages will become apparent from the following specification taken in connection with the accompanying drawings.

DESCRIPTION OF THE PREFERRED EMBODIMENT

Figure 1:
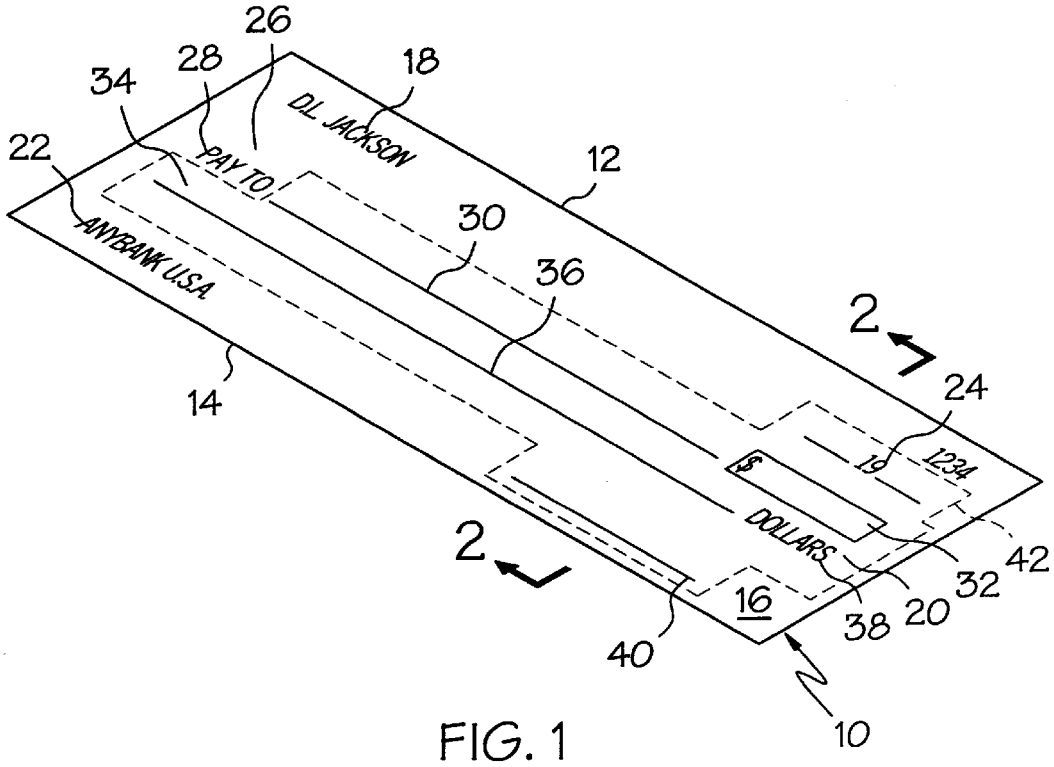
FIG. 1 is a perspective view of a secure document made according to the invention.

An exemplary embodiment of a secure document is illustrated in FIG. 1 in the form of a check. The same includes a rectangular substrate or ply, generally designated 10 which typically will be formed with paper or the like. As illustrated, a single form length is illustrated but those skilled in the art will readily appreciate that the invention is applicable to continuous business forms wherein a series of the documents illustrated in FIG. 1 are connected together by transverse lines of weakening at the top edge 12 and bottom edge 14 of each form length.

The upper surface 16 of the document 10 is printed with indicia providing fixed information. For example, at the area 18, the identity of the payor of the check is shown. A currency denomination may be shown in the area 20 and an identification of the bank containing the funds to honor the check is shown in the area 22. Elsewhere, the document 10 includes indicia that designates areas for receipt of variable information. For example, indicia 24 provide an indication that variable information in the form of the date that the check is written should be entered. Indicia 26 including words 28 and a line 30 indicate that the variable information in the form of the identity of the payee should be entered.

At a location 32, there is indicia that indicates that the numerical value of the check should be entered while in an area 34, there is indicia in the form of a line 36 and a word 38 indicating that the written value of the check should be entered. Finally, a signature line 40 acts as indicia to indicate that the payor's signature should be entered.

While these various areas could all be subdivided into individual areas, in the embodiment illustrated in FIG. 1, a single area denominated by a dotted line 42 contains them all.

Figure 2:
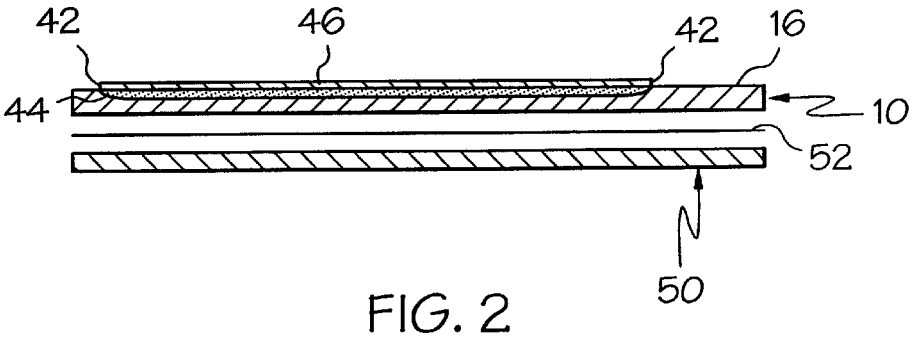
FIG. 2 is a sectional view taken approximately along the line 2—2 in FIG. 1.

Turning now to FIG. 2, it will be seen that the upper surface 16 of the document 10 is provided with a chemical carbonless imaging system 44. As is well known, these systems are such that they respond to the application of pressure or an impression by a writing or printing instrument with the production of a visible image at the point of application of the pressure. Such systems are frequently known as CFB systems and typically are made up of microcapsules containing chemicals which interact with one another to produce a visible image or simply microcapsules which contain an ink. When the pressure or impression ruptures the capsules, the chemicals mix and react or the ink is released to form the image.

The entirety of the area 42, or at least those parts thereof that are intended to receive variable information, are provided with the chemical carbonless imaging system 44 in a conventional fashion.

Overlaying the chemical carbonless imaging system 44 is a thin film 46 of transparent material. In the usual case, the film 46 will be in the form of a coating which preferably at least partially penetrates the paper substrate forming the document 10 and/or otherwise bonds to the paper substrate as would a conventional paint. The film 46 will be transparent, and preferably will be colorless to minimize any contrast with the underlying substrate forming the document 10.

Most preferably, the film 46 will be ink receptive which is to say that when common inks employed with typewriter or printer ribbons are impressed on the film 16, a visible image will remain thereon and will be such that it cannot be wiped off. Of course, when printing occurs, the chemical carbonless imaging system 44 will also be activated by the impression which transfers ink to the film 42 and the same image will be formed within the imaging system.

Ultraviolet light cured coatings commonly employed in the printing industry or business forms industry may be employed in forming the film 46.

In some cases, a multiple ply document may be desired. In this case, a second ply, generally designated 50, and typically of paper, will be placed in substantial abutting relation with the document 10. Image transfer material 52 of conventional nature may be located at the interface between the ply 50 and the document 10 with the consequence that when the document 10 is imprinted upon, the characters imprinted thereon will be transferred by the transfer material 52 to the record ply 50. While the image transfer material 52 is illustrated as a separate element in FIG. 2, such as would be the case if interleaved carbon were employed, it should be understood that the image transfer material could be a CF-CB system or a hot spot carbon system if desired.

Of course, more than one additional ply could be used if desired.

Once imaged, the image will be on the document 10 in the form of residual ink on the film 46 as well as contained within the chemical carbonless imaging system 44. If one attempts to alter image on the film 46, one of two things will occur. If only the image on the film 46 is disturbed, then the image formed in the chemical carbonless imaging system 44 will remain unchanged from its original form and the alteration will be readily apparent simply by viewing the image in the chemical carbonless imaging system 44 through the transparent film 46. Consequently, a recipient of the document will be immediately able to determine that it has been altered.

A second possibility also exists. Because of the relatively fragile nature of the microcapsules that contain a typical chemical carbonless imaging system such as that shown at 44, attempts to alter the printing on the film 46 are apt to cause rupture of capsules in the chemical carbonless imaging system 44 with the result that smudging will occur. Such smudging will be readily visible around the altered image now appearing on the film 46 to provide an indication that there has been alteration of the document.

Because of the nature of the film 46 which, as mentioned previously, preferably bonds to the surface of the paper substrate or penetrates the paper substrate forming the document 10, it is virtually impossible to access the chemical carbonless imaging system 44 to alter its operation or imaging in any fashion. As a consequence, the protection featured offered by the presence of the chemical carbonless imaging system 44 informing a duplicate of the image of that originally imprinted upon the film 46 cannot be defeated.

What is claimed is:

1. A secure document comprising:

a first ply;

indicia on said first ply, including at least one indicium designating an area to receive variable information by means of a writing or printing instrument and whose alteration is to be avoided;

a chemical carbonless material on the surface of said first ply covering said area and operative upon receipt of pressure by a writing or printing instrument to form a visible character or characters at the point or points of application of the pressure; and a thin transparent coating covering said chemical carbonless material, said coating being bonded to said first ply over said areas.

2. The secure document of claim 1 further including a record ply substantially abutting said first ply and an image transfer material between said plies whereby an impression formed on one of said plies will be transferred to the other ply.

3. The secure document of claim 1 wherein said film is an ultra-violet light cured coating at least partially penetrating or bonded to said first ply.

4. The secure document of claim 3 wherein said ultraviolet light cured coating is ink receptive so that a visible image may be formed thereon.

5. A secure document comprising, a substrate for defining the body of the document;

indicia on said substrate designating an area to receive variable information by an impression and whose alteration is to be avoided;

a chemical carbonless imaging system of the surface on said substrate covering said area and operative to form a visible image upon receipt of an impression, and a transparent coating covering said chemical carbonless imaging system, said coating being bonded to said substrate over said area.

6. The secure document of claim 5 further including a printable ply in substantial abutment with said substrate and an image transfer material between said printable ply and said substrate.

7. A secure document comprising:

a document base including a flexible substrate of a desired size and shape;

indicia on one surface of said substrate including at least one indicium designating an area for receipt of variable information that is not to be altered;

a chemical carbonless imaging system on said one surface and covering said area; and an ink receptive ultraviolet light curable coating covering said chemical carbonless imaging system and at least partially penetrating or bonded to said flexible substrate over said area.

* * * * *

UNITED STATES PATENT AND TRADEMARK OFFICE

CERTIFICATE OF CORRECTION

PATENT NO. : 6,224,111 B1
DATED : May 1, 2001
INVENTOR(S) : George Zehner

It is certified that error appears in the above-identified patent and that said Letters Patent is hereby corrected as shown below:

Column 4,
Line 26, "over said areas" should be -- over said area --.

Signed and Sealed this

Twenty-second Day of January, 2002

*Attest:*

*Attesting Officer*

JAMES E. ROGAN
*Director of the United States Patent and Trademark Office*